United States Patent [19]

Albert

[11] 4,334,506

[45] Jun. 15, 1982

[54] RECIPROCATING ROTARY ENGINE

[76] Inventor: Albert F. Albert, 422-101st Southeast, Bellevue, Wash. 98004

[21] Appl. No.: 74,338

[22] Filed: Sep. 11, 1979

Related U.S. Application Data

[63] Continuation of Ser. No. 914,927, Jun. 12, 1978, abandoned, which is a continuation of Ser. No. 632,485, Nov. 17, 1975, abandoned, which is a continuation of Ser. No. 494,633, Aug. 5, 1975, abandoned.

[51] Int. Cl.[3] ..... F02B 75/22

[52] U.S. Cl. ..... 123/55 AA; 123/44 E

[58] Field of Search ..... 123/43 C, 44 E, 44 B, 123/55 AA, 44 D, 44 R, 51 R, 53 AA, 53 R; 91/188, 496; 418/150

[56] References Cited

U.S. PATENT DOCUMENTS

| | | | |
|---|---|---|---|
| 1,252,757 | 1/1918 | Williams | 123/55 AA |
| 1,485,988 | 3/1924 | Michel | 123/55 AA |
| 3,931,810 | 1/1976 | McGathey | 123/44 E |

FOREIGN PATENT DOCUMENTS

| | | | |
|---|---|---|---|
| 640421 | 7/1928 | France | 123/44 E |
| 374834 | 12/1930 | United Kingdom | 123/55 AA |
| 446873 | 5/1936 | United Kingdom | 123/44 E |

*Primary Examiner*—Ronald H. Lazarus

*Attorney, Agent, or Firm*—Cole, Jensen & Puntigam

[57] ABSTRACT

Rotary engine having a hollow, stationary block with manifolds for air inlet and exhaust valving and means for supplying fuel. The block supports one or more in-line cylinders which are provided with opposed pistons equipped with rigid and constrained piston rods. The rods carry bearings that run along a cam track surface interior to a disc, the outer surface of which is a right circular cylinder. The surrounding right circular cylinder rotates as a result of the linear movement of the opposed pistons thereby providing mechanical power. The cam surface is a continuous track which determines the out-put motion of the piston movement between top and bottom dead center. Arcuate areas at top and/or bottom dead center permit constant volume combustion and/or exhaust as desired during a particular cycle, whether that cycle be Otto or Diesel and whether it be two or four stroke.

41 Claims, 16 Drawing Figures

FIG. 1
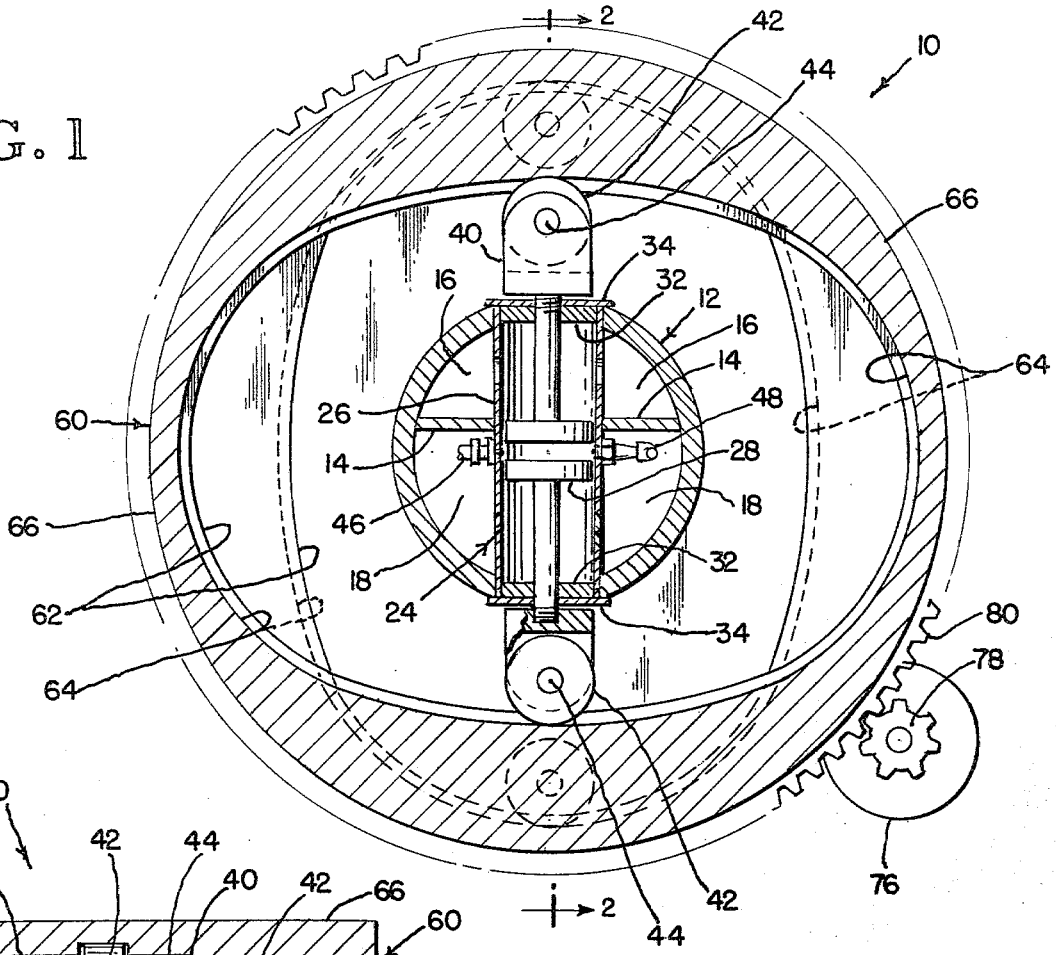
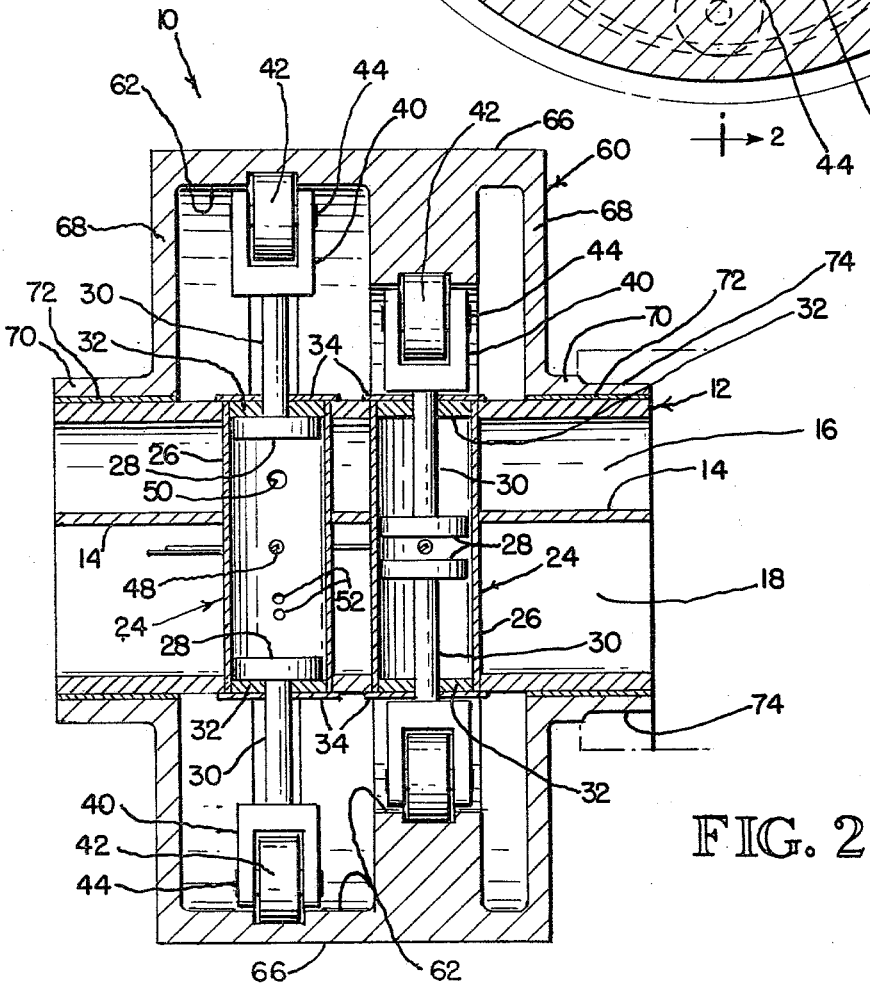
FIG. 2

BOTTOM DEAD CENTER
START COMPRESSION
INTAKE VALVE CLOSING

COMPRESSION STROKE
BOTH VALVES CLOSED

TOP DEAD CENTER
MIXTURE IGNITED

POWER STROKE

BOTTOM DEAD CENTER
START EXHAUST
EXHAUST VALVE OPEN

EXHAUST STROKE
EXHAUST VALVE OPEN

TOP DEAD CENTER
BEGIN INTAKE

INTAKE STROKE
INTAKE VALVE OPEN

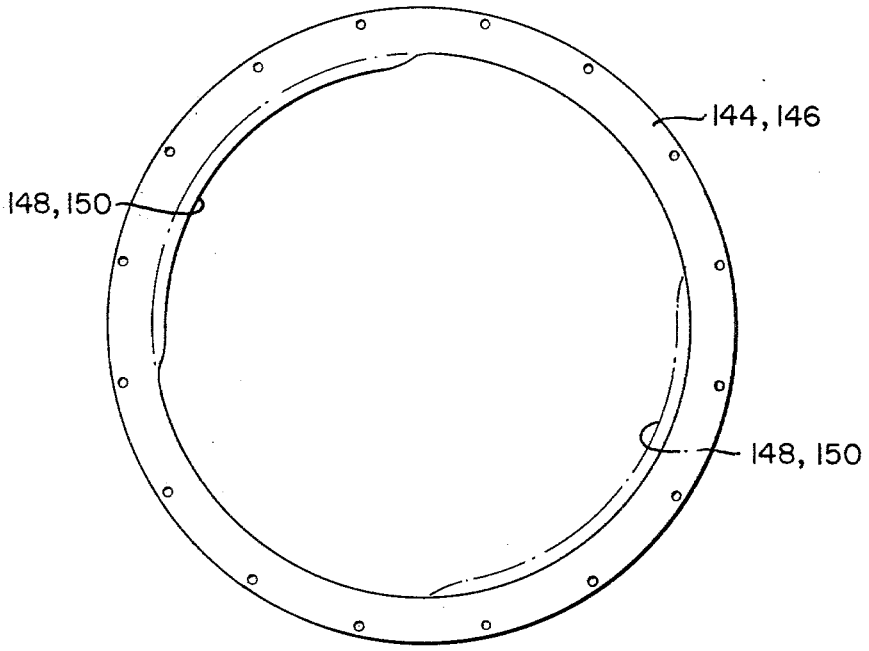
FIG. 15
FIG. 16
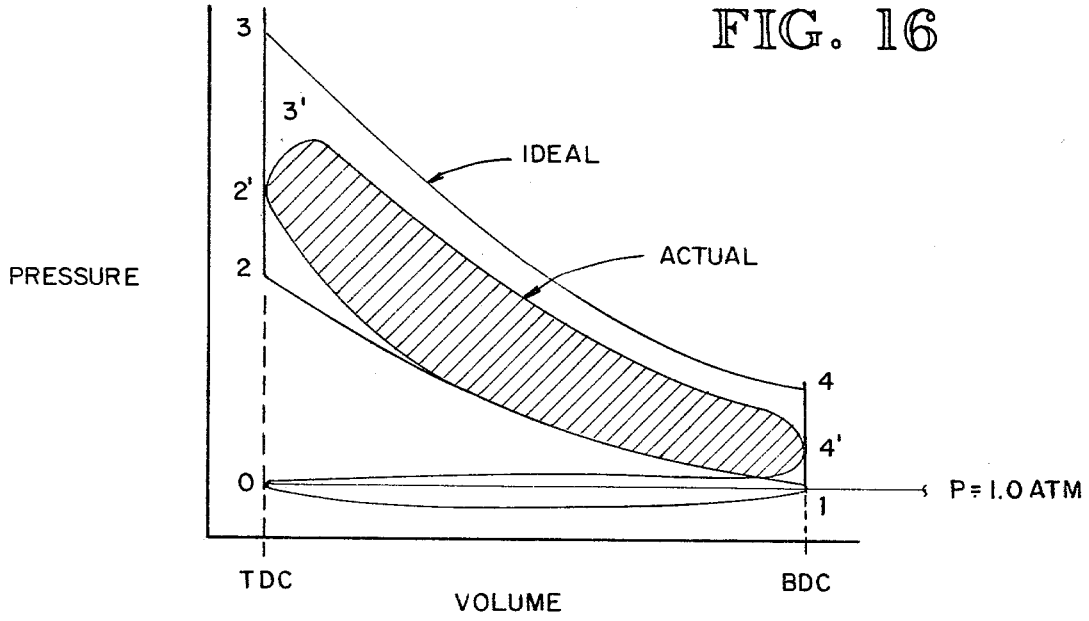
SCHEMATIC IDEAL
SPARK IGNITION OTTO CYCLE

RECIPROCATING ROTARY ENGINE

This application is a continuation of U.S. patent application Ser. No. 914,927 filed June 12, 1978, now abandoned, which application is a continuation of U.S. patent application Ser. No. 632,485 filed Nov. 17, 1975 now abandoned, which application is a continuation of U.S. patent application Ser. No. 494,633 filed Aug. 5, 1975 now abandoned.

BACKGROUND OF THE INVENTION

The invention relates to the art of rotary engines and more particularly to a rotary engine having an exterior rotary output member driven by opposed pistons housed within a stationary cylinder or stationary in-line cylinders.

The reciprocal internal combustion engine, as those skilled in the art are well aware, is the result of at least 75 years of technological progress. The method of converting heat energy input to mechanical energy output, while regarded today as highly developed, is less efficient than is possible since conversion of the heat energy to mechanical energy is done through the piston, connecting rod and the crankshaft to the rotating output member. This is true whether the internal combustion be by spark ignition or by compression ignition. The losses in the system are well recognized and have been extensively examined over the years. The inefficiency of the connecting rod-crankshaft piston engine is one of the reasons why a good deal of effort has been turned since World War II to the development of the rotary, turbine and other types of compact power units.

The constraints imposed by connecting rod, crankshaft type engines are numerous. Connecting rod length and crank radius with their fixed interrelationship to the piston are the primary contraint factors and exert a profound influence on the piston travel function and ultimately on the engine performance. The rapid piston motion, rise to and fall from top dead center, at speed, present the greatest problem to the engine designer since ignition must occur prior to the engine's achieving full compression so as to provide time to reasonably complete burning which continues while the piston moves away from top dead center. Thus, the connecting rod and crankshaft constraint effectively prevents achievement of constant volume combustion of the ideal cycle. A substantial amount of heat is lost from the combusting fuel or working fluid because of the relatively slow expansion process which is determined by the interrelationship of the connecting rod, piston and crankshaft. Additionally, in conventional reciprocating piston engines the exhaust valve will be opened before the piston has reached bottom dead center thereby causing additional loss of energy.

In combusting the compressed fuel and thus providing energy to do work on the piston much energy is lost through the cylinder head as waste heat. Energy is lost because of the amount of surface area exposed to direct flame during combustion process and combustion must be started before the piston reaches top dead center, causing the piston to compress an already expanding gas. Energy dumped into the coolant of a conventional engine, as waste heat, may be up to as much as 60% of the total energy available from the burning fuel.

The linear piston movement in the power stroke is the initial conversion step from heat energy to mechanical energy. The linear motion is in turn converted to the angular motion of the connecting rod which in turn develops the circular motion of the crankshaft. Each of these components subtracts from the final energy output and is a design which is completely unbalanced. Balance is achieved with the addition of compensating weights. Any excess weight which must be designed into the engine in the form of counterweights, flywheels and other compensation features and frictional losses associated with the motion of such parts uses up energy to lessen engine efficiency.

As is well known, a four stroke cycle engine turns its crankshaft 720° from combustion stroke to combustion stroke on a given cylinder. A two stroke cycle engine turns its output shaft 360° from combustion stroke to combustion stroke. In either the four stroke cycle or the two stroke cycle engine the distance in degrees rotation, from the point of applied energy to the output, is large since the design of the mechanical system, in the case of the four stroke cycle, is such that for each positive power stroke of the piston there are three (3) negative strokes the piston must go through. Further the length of the connecting rod and the diameter of the crankshaft are directly related to the stroke of the piston. In net effect, there has been a great need in the automotive industry to develop a different engine, initially for higher specific power output per pound of weight and more recently to improve mileage and reduce pollution.

There are fundamental reasons why the industry has not leaped into new engine production. Among those are the fact that most engine cycles lead to larger and more expensive units than conventional power plants and are of such design that they radically depart from known technology. This is particularly true of external combustion engines. Further, of the immediate reasonable alternatives, such as for example, the Wankle rotary or the gas turbine, each has difficulties. The Wankel which is a compative engine for small vehicles does not economically scale upwardly in power, and it is an example of radical departure from known technology. The turbine which is competitive for large vehicles does not scale down in power or size economically. However, the internal combustion engine does not burn fuel completely, is very complex and its mechanical and thermal efficiency leaves much to be desired to say nothing of its fuel consumption and horsepower loss.

Among the prior art references considered to be of interest are U.S. Pat. Nos. 1,252,757; 1,485,988; 1,533,514; 2,149;591; 3,688,751; and 3,874,348.

SUMMARY OF THE INVENTION

The Almar cycle rotary engine of this invention is provided with a stationary support block of optional shape which is supported at both ends. Mounted in and on the block support are at least one but optionally a plurality of aligned, parallel cylinders containing opposed pistons.

The fixed support block is hollow so that the fuel line spark wires and intake and exhaust manifolds are conveniently directed to each cylinder. The pistons are provided with rigid piston rods at the outer end of which is mounted a bearing for engaging with and exerting linear pressure on an inclined inner cam surface of a surrounding right circular cylindrical rotary output member. The rotary output member is rotatably supported on block journals and is circular around the outside. The inside is provided with a continuous cam surface for each cylinder, which at certain positions of rotation is inclined to the radial axis of the piston and which is engaged by the bearings. While the continuous cam surface is not necessarily an ellipse or a symmetrically continuous curve it has several consistent and common characteristics. The continuous cam track will provide for two top dead center areas of constant volume and, in some cycles, two bottom dead center areas of constant volume alternated so that the cam track will be generally suggestive of an ellipse in which the opposed radii will be symmetrical and which will have a major and a minor axis at right angles to each other. At top dead center only or at top dead center and bottom dead center arcuate areas of constant volume radius from the axis of rotation are provided. The expansion or power stroke section of the invention, referred to as the Almar engine, will occupy the initial area or general quadrant section of the cam which may actually be more or less than 90° of rotation. The power stroke area may be followed by a bottom dead center, constant volume radius area which will be on or near the long or major axis of the cam curve. In the case of the four-stroke-cycle, the bottom dead center area of constant volume radius will be followed by an exhaust section and after that another top dead center area radially and symmetrically opposed from the first top dead center area. The third general quadrant section of the cam track is in an intake section and its profile is the same as and is symmetrically radially opposed from the power stroke or expansion section. In the last or fourth general quadrant section the cam track will provide for compression back to top dead center and the profile of this fourth section will be the same as and symmetrically radially opposed to the exhaust section.

Except in the case where the cam is of a mathematically defined harmonic motion design, at no time does any point on the profile of the cam surface extend beyond a straight line which is tangent to the last point of constant volume radius. No reverse curve such as would be defined by inwardly extending lobes are provided. Transition areas between arcuate constant volume sections are defined to be smooth for placing the least amount of stress on the bearings and to assure the bearings are in constant contact with the cam surface. There will be a continuous cam surface for each cylinder in a multi-cylinder engine. The axes of each cam will be positioned or rotated with respect to each other so that the mass of the rotary output member remains balanced. It can be readily seen that in the case of the multi-cylinder engine in which the firing order is in rotation, e.g. no two cylinders fire at the same time, the positioning or angular rotational offset of the cams to maintain balance is determined by the number of cylinders. However, in the instance where the cylinders fire at the same time it is necessary to design all cams to be in balance within themselves. The outside of the rotary output member may be provided with gears to be engaged by a starter motor and for power takeoff.

Accordingly, it is among the many features, advantages and objectives of the invention to provide a reciprocating rotary engine in which the combustion chamber is formed in conventional, opposed piston configuration which utilizes all the refinements and advances of reciprocating engine technology. The design of the engine allows for the most rapid expansion process possible during the power stroke to reduce heat loss through conduction while converting heat energy to useful work. The engine completes its power stroke in at least one half the time of the conventional connecting rod engine and thus its expansion time will be at least twice as fast. The Almar engine allows for maximum possible expansions to utilize as much of the heat energy as possible for useful work, with the lowest temperature exhaust gases consistent with the chosen cycle being emitted. The engine can be designed to run as a complete or extended cycle engine. The engine produces maximum possible pressure prior to expansion without combustion starting before the piston reaches top dead center. The increased speed of expansion from top dead center to bottom dead center results in less heat loss to the cylinder walls.

Because of constant volume combustion, the ingested fuel air mixture can be ignited after the piston has reached top dead center. This arcuate area of constant volume radius can be disigned to a specific burn time as determined by the quality and type of fuel used. The areas of constant volume at bottom dead center in a four stroke engine allow for maximum expansion of the gases before the exhaust valves open. This constant volume allows a dwell time for the piston during which the exhaust valves are opened thereby relieving pressures after employable heat and pressure are utilized and before the exhaust stroke is begun. The instant invention causes a more rapid compression stroke than con-rod engines which results in less heat exchange time between fuel/air mixture and cylinder walls thus reducing heat loss. Valve timing becomes less critical due to the capability of the pistons to dwell at top and bottom dead center. This is significant because it permits more design flexibility in valve timing and minimizes valve overlap and slower valve rise and fall. Minimizing valve overlap will give greater volumetric efficiency with less intermixing of exhaust-intake gases.

The engine is basically free from vibration and is dynamically balanced. The thrust forces are equalized by equal and opposite motion of the opposed pistons. Because of cam design and inherent engine characteristics all acceleration and deceleration transitions are smooth, vibrations from the piston rod bearing-cam interface are minimized and there is no intermittent loss of contact between cam surface and bearing. The sleeve, friction or frictionless bearing which keeps the piston rod from moving in a direction perpendicular to the linear movement of the piston, is placed as close to the load, i.e. the cam surface, as possible which is at the extreme end of the cylinder wall or support housing.

The engine is basically free from objectionable knock or pre-ignition arising from pressure peak singularities which normally occur as a result of continuing compression after combustion has started and as a result of poor fuel-air mixture.

The period of constant volume at bottom dead center, and the speed of the intake stroke more completely mix the fuel-air mixture which is very helpful in achieving uniformity of the ingested charge prior to combustion and causes the engine to be more tolerant of lean mixtures. Burning of lean mixtures results in better emission management and less tendency to misfire. Since the combustion chamber is formed between two pistons shaping such chamber to minimize knock is much simpler than in the conventional engine. Heat loss is minimized by the efficiency of the cycle and the speed of expansion as well as the minimized cylinder surface through which heat can be conducted. There will be minimum restrictions on inflow during the intake process. The engine will make minimum contributions to pollution because it is possible to turn very lean mixtures in constant volume areas as well as to more completely burn the fuel.

The engine has great design flexibility in that a variety of cam designs can be chosen to fit the specific characteristics of a given fuel. A wide variety of cycles can be chosen with the same basic configuration and the cam surface configuration can be varied to adapt the piston velocities to a specific end work use. Mass of the rotating member can be altered within the same basic configuration and the profile of the cam designed to provide a wide range of piston travel characteristics to optimize the time of constant volume and to tailor compression and expansion curves as befits various fuels and/or cycles. This engine also enables the designer to fire a multi-cylinder engine in rotation, that is firing cylinders sequentially or to fire some or all of the cylinders at the same time.

The continuous cam track allows the instant engine to conform more closely to an ideal thermodynamic curve which of course varies with the fuel type, compression ratio, speed of the engine, type of cycle, etc. The constant volume areas of the cam at top and bottom dead center may be related to the operating speed of the engine and/or the burning time of the fuel. The output curve becomes more closely matched to the curve of combustion at any engine speed and permits constant volume burning of the fuel charge for any type of fuel. The rotary output member can be designed for high energy storage as a result of designing weight and speed into the rotary member. The engine can be further designed to a particular intended engine and application, that is high speed low torque or low speed high torque or constant speed type engines without compensation features such as torque converters. It is an important characteristic that any desired velocity profile and any acceleration/deceleration curve can be designed into the cam or cams. As a practical matter and as a consequence of the invention's design flexibility, it is possible to achieve variances in the acceleration and deceleration profiles or characteristics. The engine is designed to complete a two stroke cycle with 180° of rotation of the output member, and complete a four stroke cycle within 360° rotation of the output member. Because of the opposed piston arrangement and the symmetrical distribution of the mass in the rotary output member there is no need for counterweights or other compensating features for maintaining balance since forces in the engine are equal. The engine can use as many in-line cyclinders as desired and the cams can be rotated to desired angles, to fire the cylinders simultaneously or to fire them in series, thus making the engine extremely versatile in its design capabilities and use applications. The engine is capable of being run with minor modifications from an external energy supply or external combustion source.

BRIEF DESCRIPTION OF DRAWINGS

FIG. 1 is a cross section view of a two cylinder four piston embodiment showing details of construction and arrangment of parts;

FIG. 2 is a cross section view along the line 2—2 of FIG. 1 and further illustrating the details of the cylinders, pistons, rotor and support manifold;

FIG. 15 shows general characteristics of a valve cam; and

FIG. 16 is a thermodynamic pressure-volume curve showing both ideal and actual curves.

DESCRIPTION OF PREFERRED EMBODIMENT

Figure 3:
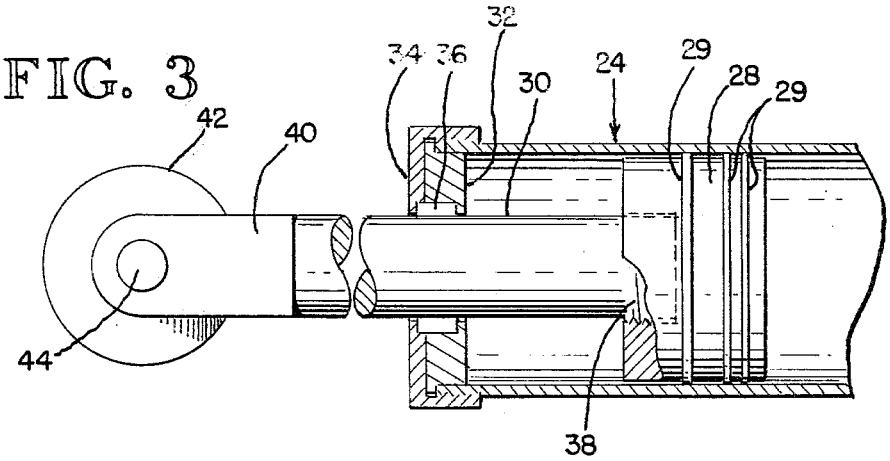
FIG. 3 is a partial cross section view showing additional details of the structure of a cylinder and piston.

As those skilled in the art are aware, it is necessary to understand the constraints imposed on the design of a connecting rod-crankshaft type reciprocating engine in order to more clearly appreciate how the engine of this invention removes such constraints. Essentially the constraints are the connecting rod lengths from the wrist pin axis of the piston to the crank axis, and the crank radius from the crankshaft rotation axis to the crankshaft-con rod connection. The relationship between the linear travel of the piston and the angle of crankshaft rotation is determined by the ratio of connecting rod length to crank radius. The ratio of connecting rod length to crank radius has a profound influence on the piston travel function and ultimately on engine performance. The rapid rise and fall of the piston to and from top dead center presents the greatest problem to the engine designer for it precludes burning at a constant volume at top dead center and necessitates advance ignition to allow time for the fuel to burn. For example, an engine operating at 4800 rpm from the time of spark to the end of the fuel burning period takes .002 seconds. This burn time occupies 57° of time rotation. Thus, firing in the conventional con rod crankshaft engine must begin well before top dead center and obviously results in a direct loss in efficiency, specific fuel consumption and horsepower.

FIG. 16 represents a general comparison of the actual and ideal thermodynamic curves for an Otto cycle and illustrates where the losses occur between ideal and actual. Such a curve is commonly seen in treatises which analyze and compare ideal performance with the actual.* The compression stroke is represented by the line 1—2. An ideal combustion line would be represented by 2—3. The expansion cycle line is shown from 3 to 4 at which time the exhaust ports would be opened and the pressure would drop along the line 4—1. The exhaust stroke would be represented by 1—0 and the intake stroke by 0—1 and thence back to the repression stroke 1—2. In performance, however, the actual cycle is comparatively represented by the cross hatched portion showing a substantial loss of efficiency in the engine. The work of the cycle outside the cross hatched portion is not realized. It is among other things the requirement to begin burning the fuel prior to top dead center, the relatively slow expansion process during and after combustion, and the opening of the exhaust valves prior to the piston reaching bottom dead center that account for the losses resulting in the actual curve as opposed to the idealized curve.

*OBERT, "Internal Combustion Engines", p. 497ff, 3rd Ed., International Textbook Company, 1968. LEWIS, "Gas Power Dynamics", pp. 443-513, Van Nostrand Company, New York, 1962.

The advantages of the instant engine accrue from features inherent in its design. The essential mechanical arrangements of parts and particularly cam design permit the engine to have the smallest surface to volume ratio during combustion; the most rapid possible expansion stroke; the maximum possible pressure at the beginning of the expansion stroke without advanced ignition; and the maximum possible expansion. Finally, the simplicity of the design lends itself to economical construction and low weight with the consequent attainment of higher specific power and overall cost savings because of fewer parts.

A two stroke embodiment of the invention is shown in FIGS. 1 through 5 and illustrates the construction and general operating principles of two stroke engines. The engine, generally designated by the number 10, consists of a hollow manifold block support member generally designated by the number 12. The member 12 is elongated as shown in various drawings and is fixed at both ends so that it is stationary. Internally it is provided in this case with a partition 14 which as can be seen is slightly offcenter for reasons which will be explained hereinafter. Partition 14 divides the inside of member 12 into an exhaust manifold section 16 and an intake manifold section 18. It will be quite apparent that intake and exhaust manifolding could be formed of piping or tubing and directed to the cylinders without partitioning the interior of the manifold block. Supported by the manifold member 12 are cylinders generally designated by the number 24. The cylinders have wall 26, pistons 28, a piston rod 30, rod control bearing mount or support 32 and threaded cap 34. Rod control bearing 36 is supported in rod control bearing support 32. It will be noted that piston rod 30 is rigidly attached to the piston as by threads 38 and is supported by rod control bearings 36. At the outer end of piston rod 30 is secured a roller bearing mount 40 in the shape of a yoke supporting roller bearing 42 on pin 44 which extends into both arms of yoke 40. It is to be noted, however, that other kinds of bearings may be used such as friction, frictionless or slipper types. It will be appreciated that the cylinders are provided with fuel line 46, spark plug 48, exhaust gas ports 50 and air intake ports 52.

Figure 4:
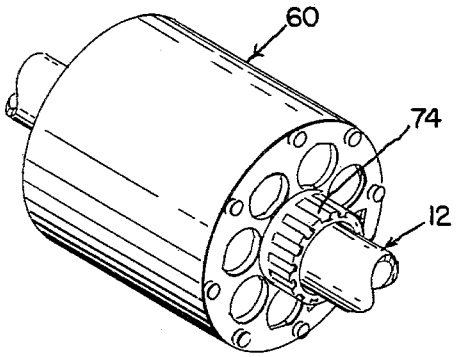
FIG. 4 is a perspective view showing how the rotor might look from the outside but without any protective housing around the rotor.
Figure 5:
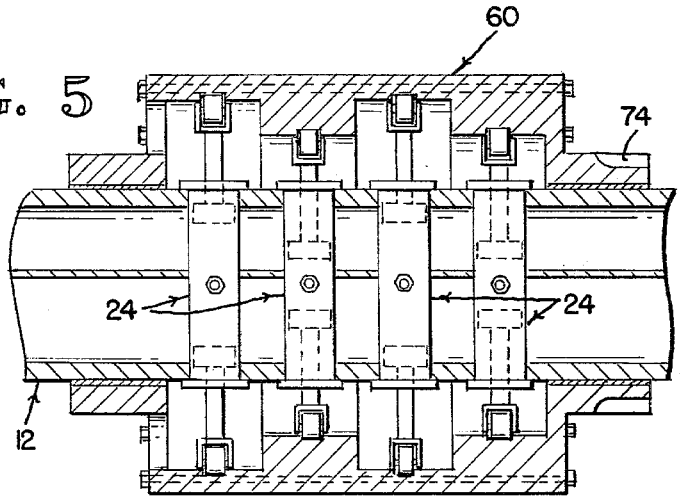
FIG. 5 is an additional view showing four cylinders in line.

The rotatable member or rotor generally designated by the number 60 is in effect a series of cam surfaces 62 or any other geometrical combination of curves which will allow the piston to make a complete stroke within a predetermine number of degrees rotation in a single revolution. The continuous cam surface may be epicycloidal or formed in various symmetrical or asymmetrical configurations resembling an elipse. The exact configuration of the cam will vary depending, for instance on the degrees of rotation desired to complete a power stroke and the radii lengths in a particular section of the cam as will be discussed in more detail below. It will be noted that the outside of the rotor is round and that for balance of weight, the long axis of one cam surface 62 is in line with the short axis of the adjoining cam surface 62. In this way, as explained above, weight distribution in the rotor is balanced and cylinders 24 can be arranged in line in the stationary manifold support 12. Such angular offsetting of the cams also contributes to strength in the rotor. The cams are provided with tracks 64 to engage in this instance, piston roller bearings 42. The number of cylinders, of course, will depend upon the horsepower desired and such other factors as the particular application or use of the engine. Rotor 60 has end walls 68 provided with a series of openings such as is shown in FIG. 4. In some designs it might be desirable not to have these openings so that the cam and roller chamber acts as a lubricant reservoir. Bearing or bushing sections 70 are provided at each end of the engine and are journaled on bearings or bushings 72. Gear teeth 74 will be provided for a power output. FIG. 1 shows that a starter motor 76 with pinion gear 78 will engage ring gear 80 around the periphery of rotor 60.

The cam for a two stroke engine will have an area of constant volume (constant radius) at top dead center the arcuate area of which may vary according to the type and burning time of the fuel the particular engine is designed to use. If the two stroke engine uses ports for manifolding instead of valves there will be no constant volume area at bottom dead center because of the Kadenacy effect*, that is the negative pressure created in the cylinder by the opening of the exhaust port. If the two stroke engine is manifolded with valves the the area of constant volume at bottom dead center is necessary for the same reasons as pertain to the four stroke embodiment discussed hereinafter.

*IRVING, "Two-Stroke Power Units", pp 20 et seq, Hart Publishing Co., Inc., New York City, 1968.

As explained above, the Almar engine is versatile in that it can be used in two stroke or four stroke mode in spark or compression ignition. For instance, in FIG. 5 four cylinders 24 are used, but it will be understood that one or three cylinders may be used or more than four, again depending upon the intended application. It will be appreciated that if an odd number other than one, of cylinders are used, such as three, the cam surfaces would be rotated 120° to each other, again to keep the rotor balanced. In the instance where one cylinder is used or all cams are aligned and where all cylinders fire at the same time each cam will be inherently balanced.

Figure 6:
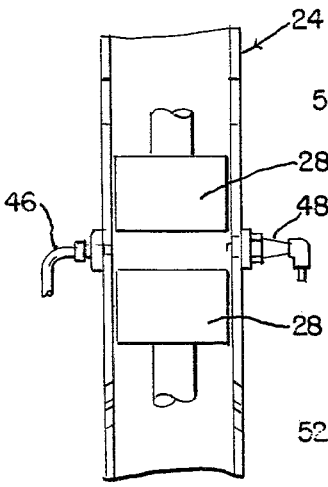
FIGS. 6 through 9 illustrate diagrammatically the operation of a two stroke almar cycle, spark ignition engine with opposed pistons as contemplated by this engine.
Figure 7:
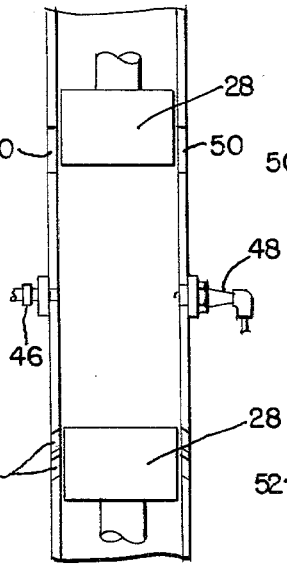
Figure 8:
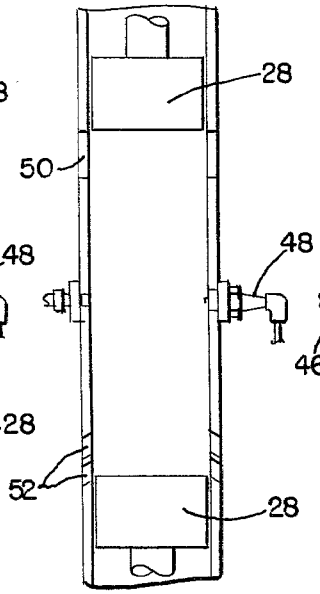
Figure 9:
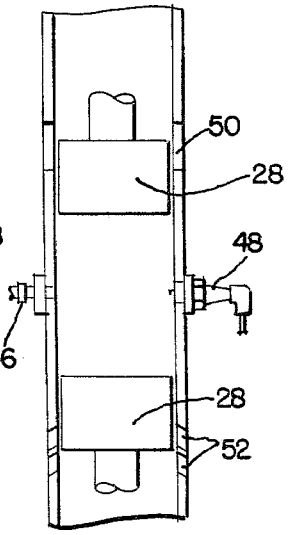

FIGS. 6 through 9 illustrate an opposed piston two stroke Almar cycle operation. Cylinder 24 in FIG. 6 is shown to be in position for a power stroke by ignition of spark 48. In FIG. 7 the pistons 28 having completed the power stroke open exhaust ports 50 before intake ports 52 are open and thus FIG. 7 illustrates the position of the piston at exhaust. FIG. 8 shows pistons 28 as having finished or completed their outward stroke at bottom dead center, so that both exhaust ports 50 and intake ports 52 are open and thus FIG. 8 represents the intake position of the pistons. In FIG. 9 the pistons have closed off both intake and exhaust ports and thus it represents the compression stroke.

FIGS. 10 through 16 illustrate details of a four stroke cycle spark ignition embodiment of the invention. The engine generally designated by the number 100 includes stationary manifold block member 102 in which is located a cylinder generally designated by the number 104. Cylinder 104 includes water or coolant jackets 106 and cylinder walls 108. As can be seen cylinder walls 108 extend outwardly to approximately the circumference or outer radial dimension of block 102 so that the cylinder has opposed ends 110. Pistons 112 are provided within the cylinders and it will be seen that each is formed with cavities 114 between which are walls or raised sections 116. Spark plugs 118 are provided for firing in the chambers defined by opposed recessed areas 114. Each piston is provided with rigid extensions or rods 120 extending outwardly to a piston rod end plate 122. An intermediate partition 124 located radially relative to the length of the stroke on each side of the cylinder provides an inner engagement surface 124. A compression spring 126 is disposed between the intermediate walls 124 and piston rod end plate 122 to resiliently bias and hold bearings 128 in engagement with the cam surface. Bearings 128 will rotate on shafts 130 and the piston rod or extension 120 will be guided by thrust control bearings 132 located at the outer ends of the cylinder. It is to be noted that while roller bearings 128 have been shown friction or slide type bearings may also be used. Bearings 128 will bear on the cam track generally designated by the number 140.

Figure 10:
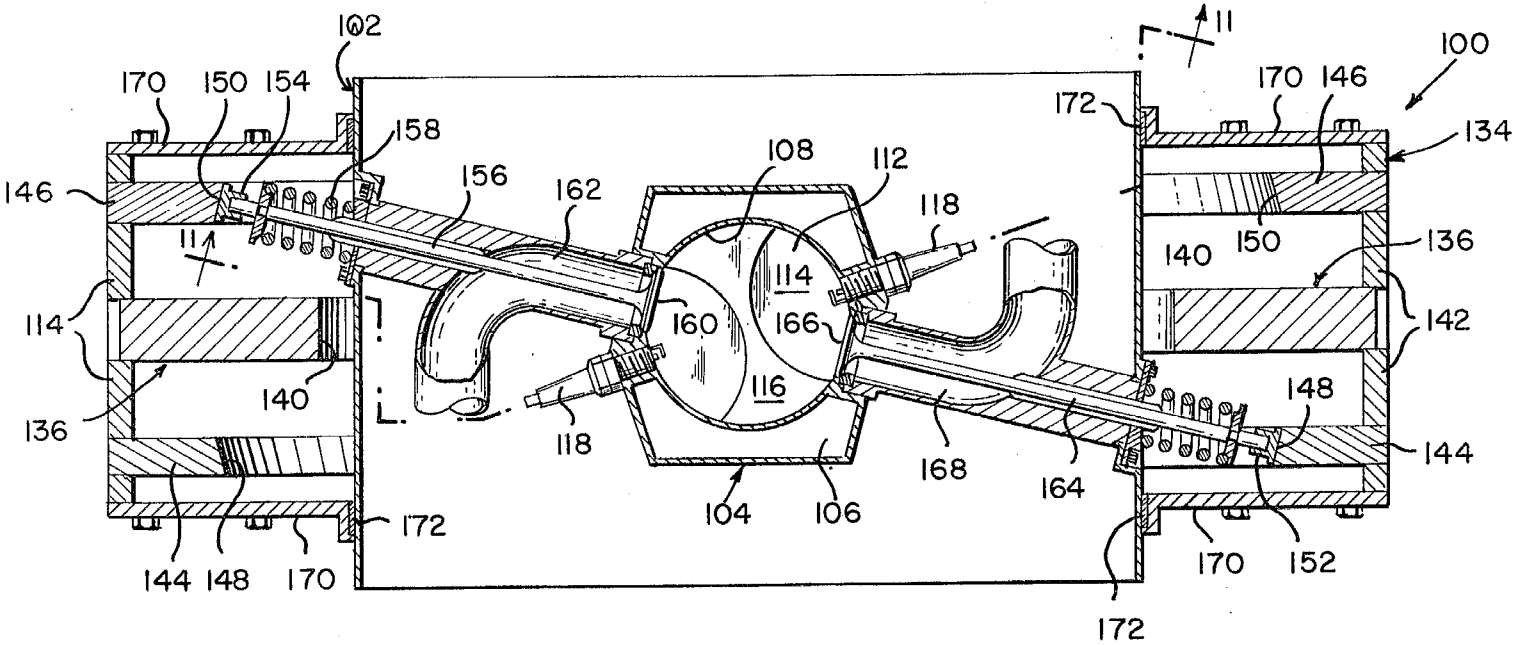
FIG. 10 is a horizontal cross sectional view along the line 10—10 of FIG. 11 showing details of a four stroke embodiment of the invention.
Figure 11:
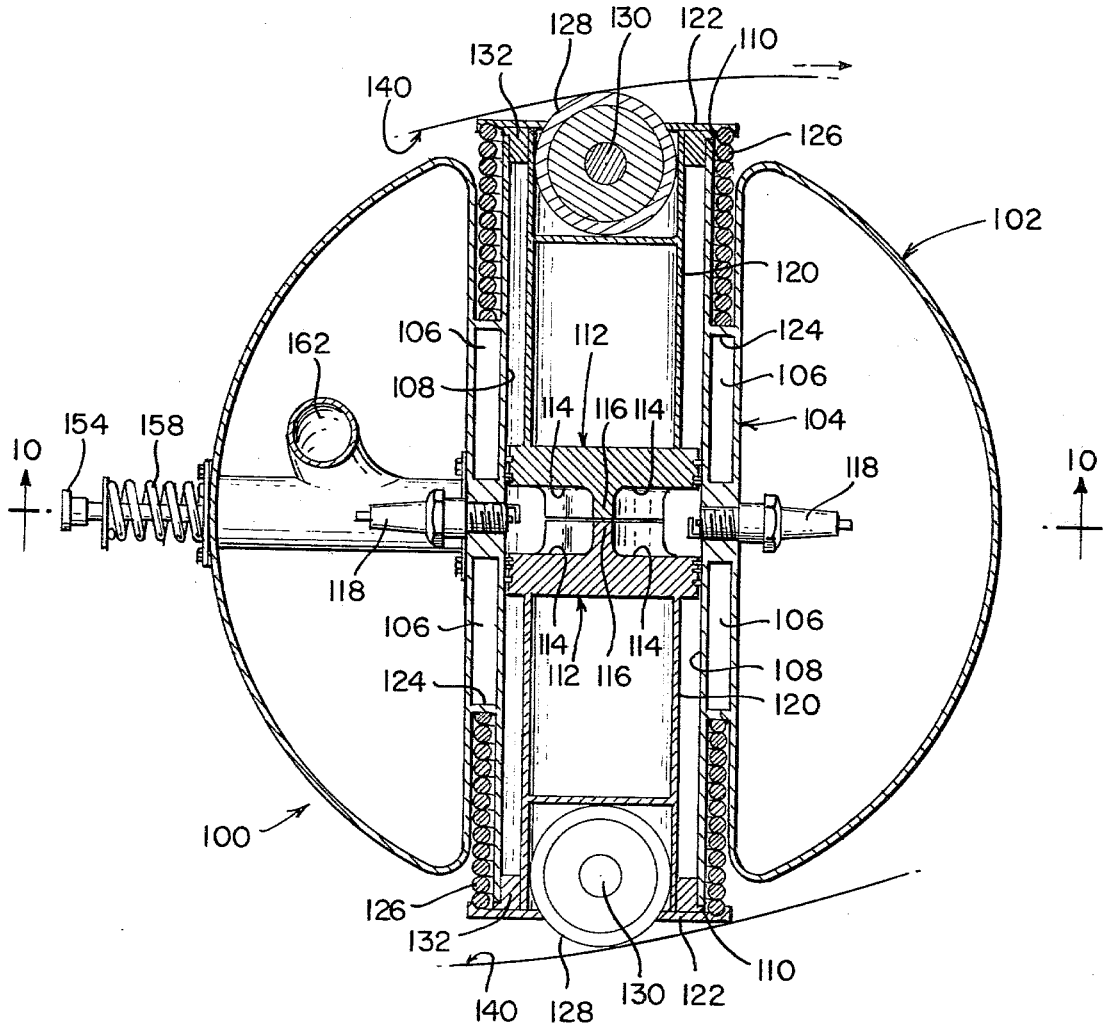
FIG. 11 is a vertical cross sectional view taken along the line 11—11 of FIG. 10 showing additional details of the four stroke Almar engine.

FIG. 10 shows additional details of manifolding and manifolding cams. The rotary output member surrounding and rotatably mounted on block 102 is generally shown by the number 134. It includes drive cam member 136 having an inner drive cam surface generally identified by the number 140. Rotary output member 134 has cam spacers 142 so that on one side of drive cam 136 is an intake exhaust valve cam 146. FIG. 15 shows that valve cams 144 and 146 are approximately identical in appearance except, of course, that the raised portions for compressing and opening the valves will be located differently according to the timing required. The cam surfaces 148 and 150 respectively of the two valve cams engage valve stem pushers 152 and 154 which could also be roller, friction or other types of bearings. If for instance, cam member 146 is the intake valve cam it will engage pusher 154 which in turn will depress valve stem 156 against spring pressure 158. Thus valve 160 would be disengaged from its seat to enable combustion gases to enter the cylinder through manifold channel 162. In like manner on the exhaust side pusher 152 engages cam 144 to depress valve stem 164 to unseat valve 166 to enable exhaust gases to be purged through the exhaust manifold channel 168. Rotary member side plates 170 are provided together with appropriate bearing seals 172 for rotatably mounting the rotary output member 134 on block 102.

FIGS. 14 and 15 are included to show that the Almar cam curve configuration is an important feature of this invention when considered with other design features. The cam which is driven into rotation by action of the expanding gases working on the pistons during the power stroke of the cycle also controls piston motion during exhaust, intake and compression strokes. The cam curvature is designed to optimize particular features of engine performance for which certain constraints in cam design are appropriate. A preferred cam surface is that which permits constant volume combustion in spark or compression ignited internal combustion engines over a wide range of engine speeds, permits the most rapid expansion of burned gases after combustion to maximize efficiency of transformation of heat energy into mechanical work, and then decelerates the piston to zero velocity as rapidly and as efficiently and with as little wear as possible. Any cam area which for instance would cause bearing 128 to lose contact with the cam surface or which would result in intermittent bearing contact would be obviously unacceptable. Also, any cam design which would cause a large side thrust against the piston rod control bearing, ie. the beginning of the exhaust and compression stroke would be unacceptable. Additionally, any portion of the cam which would give rise to unnecessary problems of stress and strain, lubrication or which were unnecessarily complex would also be unacceptable. Preferred surfaces depend for the most part upon the type of engine, fuel, materials, size, specific power, speed, design for load, and other variables.

Figure 12:
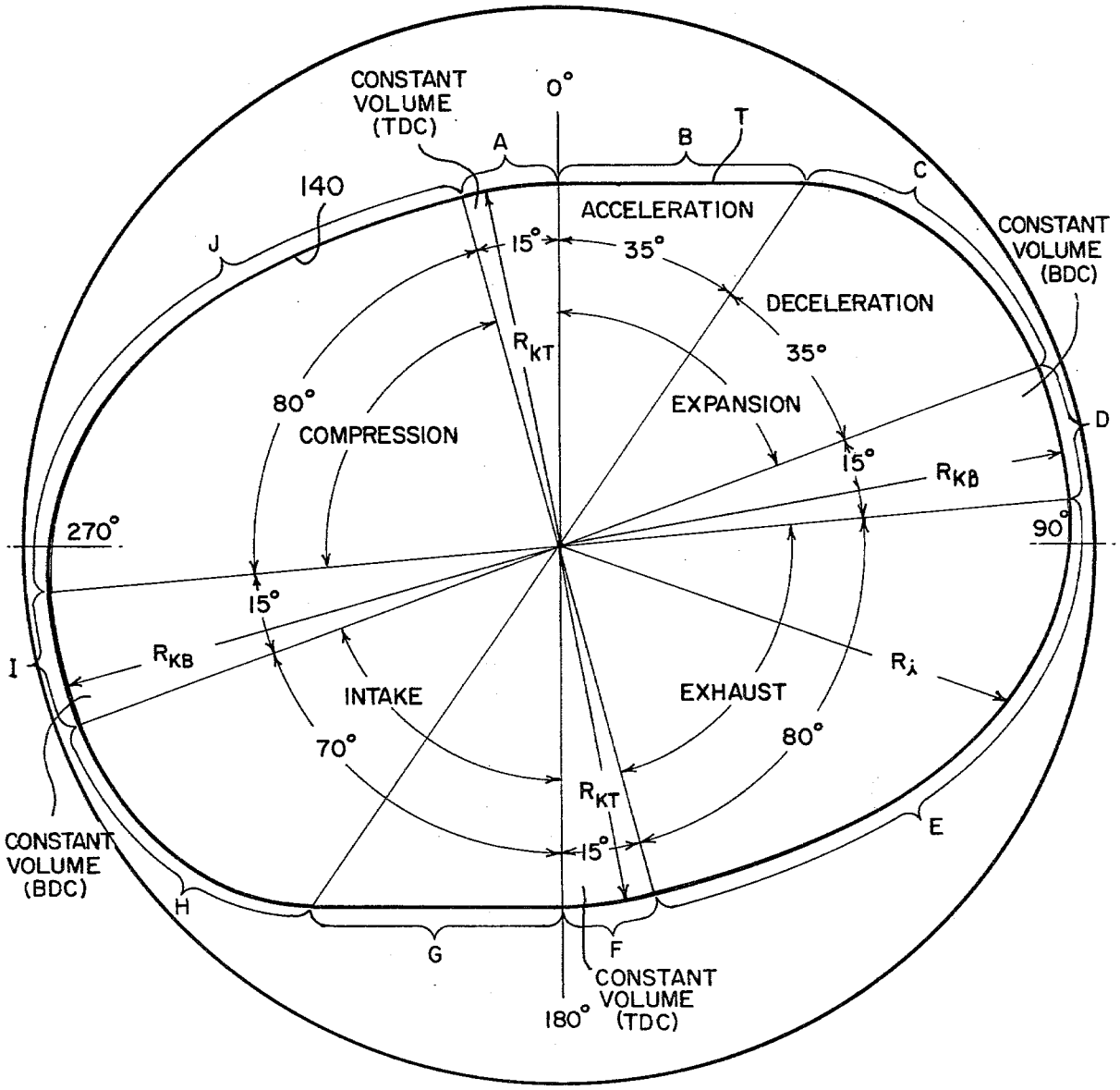
FIG. 12 shows representative details of a nonharmonically shaped valve cam.

The design constraints placed on the cam configuration are set forth in the following general propositions. The cam of FIG. 12 illustrates a geometrical limitation on the expansion or power stroke portion of the cam which enables the most rapid possible expansion of the combustion chamber or fastest possible expansion displacement of the pistons in a cylinder. The maximum rate at which the piston moves away from top dead center during combustion is in the acceleration area B of the expansion stroke and is established by a tangent line T. The maximum value of $R_i$ (index radius) in area B at any point during acceleration of the piston cannot be greater than any point on line T in area B which is tangent to the last radius value $R_{KT}$ (constant radius top dead center) of the constant volume area A. The length of the straight line T of section B extends for as long as acceleration is desired and of course as its transition into area C is smooth. C must be a smooth curve which decelerates the piston until its linear velocity is zero at the beginning of the bottom dead center area D. Again, in following the tangent line T in Section B which is tangent to circular arc A at the last constant volume radius valve $R_{KT}$ thereof, the piston accelerates as rapidly as possible while maintaining a positive contact with the cam surface while the pressure between the pistons is smoothly decreasing.

The acceleration area B is shown to subtend 35° but could be larger or smaller and it is not necessary that deceleration area C represent the same number of degrees of rotation as area B. In order to establish cam deceleration section C it is necessary that it be plotted with the same number of radii as the acceleration curve. Thus, for example, seventy-one values of $R_i$ during acceleration are established at half degree intervals for the 35° of rotation of section B. There will be the same number of values for $R_i$ in the deceleration section C if it is a larger angle but the index angle for establishing values of $R_i$ will be greater than one half degree. If the deceleration section C is smaller than acceleration section B in terms of number of degrees of rotation the values or $R_i$ for section C will be at closer angular intervals than one half degree. In any event and despite the angular intervals the same values of the changes in $R_i$ will be used in reverse order to the point at which deceleration section C joins or reaches the only or first value of bottom dead center or the constant volume $R_{kb}$. Thus, for example, if the last five values of changes in $R_i$ or $\Delta R_i$ in the acceleration curve area B are:

| Index Number | Delta (Δ) $R_i$ |
|---|---|
| 85 | .048746 |
| 86 | .048880 |
| 87 | .048941 |
| 88 | .049048 |
| 89 | .049082 |

then the first five values of $\Delta R_i$ in the deceleration curve area C are:

| | |
|---|---|
| 90 | .049082 |
| 91 | .049048 |

-continued

| | |
|---|---|
| 92 | .048941 |
| 93 | .048880 |
| 94 | .048746 |

Accordingly, while the piston during deceleration in cam section C is still moving out toward bottom dead center and $R_i$ is still increasing towards its maximum value at bottom dead center the differences in $R_i$ or $\Delta R_i$ are the reverse of the radius changes in the acceleration curve B.

Figure 13:
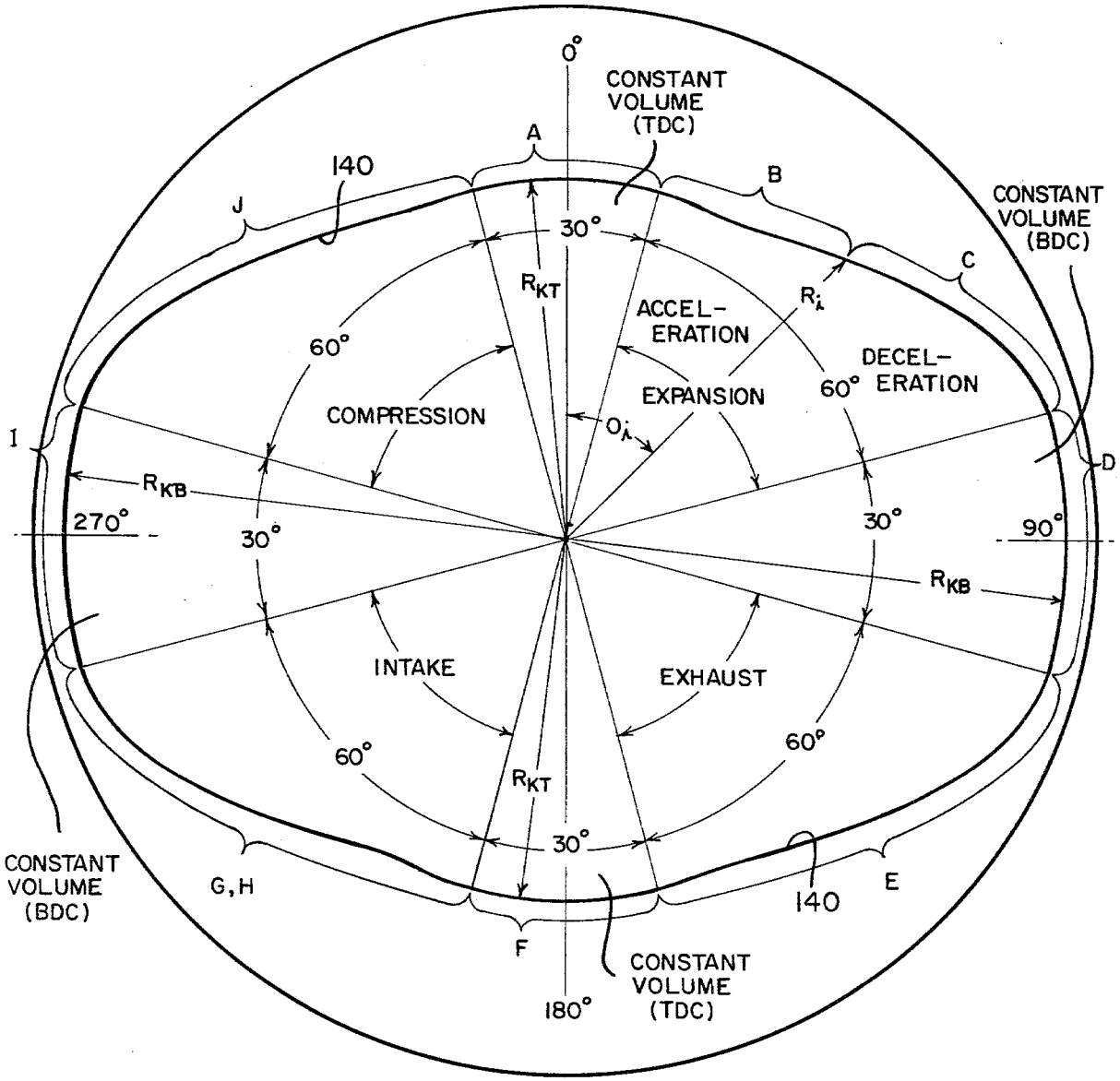
FIG. 13 shows representative details of a harmonically shaped cam.
Figure 14A:
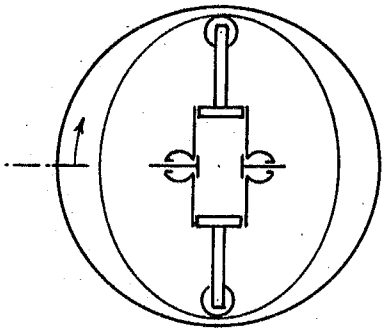
FIG. 14 shows the operational sequence of the four stroke embodiment.
Figure 14B:
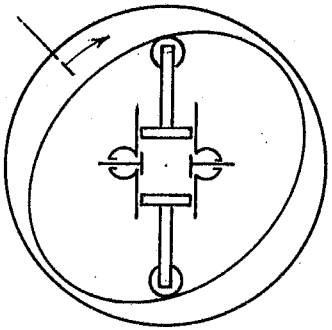
Figure 14C:
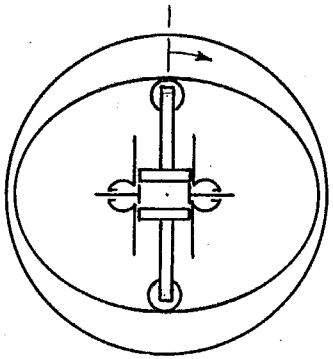
Figure 14D:
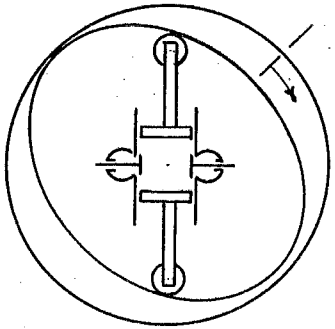
Figure 14E:
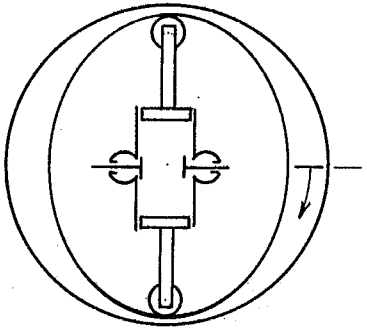
Figure 14F:
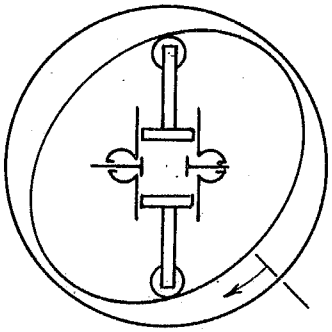
Figure 14G:
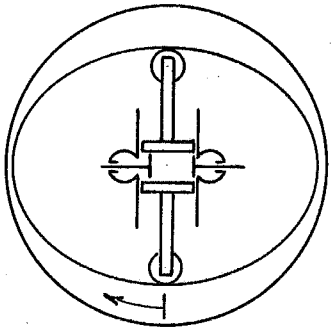
Figure 14H:
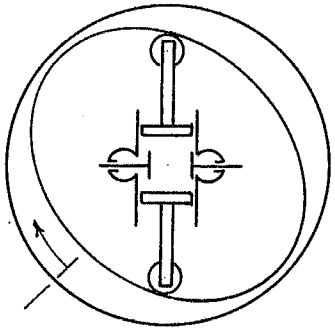

The cam of FIG. 13 represents a mathematical constraint on or expression of the acceleration-deceleration profile of sections B and C. Essentially, it is a harmonic curve extending between the last constant volume radius of top dead center and the first or only radius of bottom dead center. In short, the harmonic curve extends through the deceleration and acceleration sections of the expansion part of the cam and is generally defined by the following expression:

$$R_\theta = S + [1 - \text{Cos}\,(u)]$$

where $$u = \frac{\pi}{L}(\theta - k)$$

k=beginning radius point for the harmonic curve (last constant radius at top dead center) in degrees m=ending radius point for the harmonic curve (first or only radius at bottom dead center) in degrees $L = 180 - (k + m)$ $S = \frac{1}{2}$ distance of ravel of one piston.

It is to be repeated that the expansion section of the cam may be geometrical design or mathematical expression be greater or less than the first 90° of rotation. Again, any given radius on the cam has an opposite and equal radius so that defining 180° of the cam also defines the other 180° thus giving the cam equal and radially opposed symmetry. The cam does not require that there be an area of constant volume (radius) at bottom dead center since the need for constant volume at bottom dead center will be a design variable.

The exhaust portion of the cam is designed to return the piston to top dead center with a minimum of thrust loads against the piston rod control bearing. This is done by the cam surface being designed so that the linear movement of the piston on the return movement is relatively slow at the beginning of the exhaust stroke. When the piston has reached a point at which the distance from the face of the piston to the control bearing is larger than the distance from the control bearing to the point of contact at the cam surface, then the cam profile from such point to top dead center is designed so as to make the linear movement of the piston very rapid. This type of cam design will allow for minimum wear on the piston, the piston rods, the cylinder wall and the bearings. The same cam profile for expansion is used during that quadrant which controls the intake stroke. A very rapid movement of the piston is accomplished during the initial part of the intake stroke by which great turbulence of the fuel air mixture is created. This gives the desired complete mixing of the fuel/air ingested charge and again minimizing the wear on the parts. The compression stroke area of the cam is the opposite and radial equal of the exhaust section. It will be appreciated that any two opposing sections or quadrants of the cam will be the same so that the limitation of equal and opposite radii is not violated.

FIGS. 14A through 14H depict timed views of a one cylinder cam in a four stroke Almar cycle embodiment of the engine. The intake manifold is shown on the left side of the cylinder and exhaust manifold on the right. View A shows the engine at the beginning of the compression stroke. At this time the intake valve has begun to close and will be closed in a very few more degrees of rotation. View B shows the engine partially through its compression stroke with both vavles closed. By the time the engine reaches top dead center the compression air fuel mixture has been ignited, is burning, and is creating high pressure in the clearance space between the pistons. Note that by View C the cam has traveled only 90° of action rotation. For a normal engine using a crankshaft, the piston travels from bottom dead center to top dead center through a rotation of 180°.

On the power stroke View D, the pistons and rods are seen to drive the rotating cam in a direction to allow expansion of the hot gases. The cam is driven from opposite sides in a balanced configuration so that there is no net thrust on the cam in any direction and only radial, equal and opposite force to make the rotor rotate. Note that since the pistons are symmetrically oriented and are driven in unison there is no unbalance of piston forces which would operate to cause lateral vibration. View E shows the pistons fully extended in the position of bottom dead center and the exhaust valve and now open to expel the spent exhaust gases. Because of constant volume areas the piston is exerting pressure on the cam throughout its total travel and the exhaust valves do not have to open before the piston reaches bottom dead center. The cam's angular momentum in the case of a one cylinder engine, now carries the rotor through this bottom dead center position and begins to force the gases out of the cylinder during the exhaust stroke. With two or more cylinders or multi-cylinders where all cylinders are simultaneously fired angular momentum carries the rotor through to the next firing stroke. The angular momentum carries the cam through the exhaust stroke View F continuing to expel the gases until top dead center as shown in View G. It will be seen in the Views A through G that there is always pressure in the cylinders forcing the rod bearings to maintain contact with the rotating cam. During the intake portion of the cycle it is necessary to force the piston to extend and to this end the spring 126 as seen in other views is mounted between the cylinder and bearing. The springs are always under compression so that they act to maintain bearing contact with the cam.

What is claimed is:

1. A reciprocating, rotary, combustion engine, comprising:

(a) a hollow, non-rotatable support block member of predetermined length and adapted to be supported in an operative position, (b) at least one cylinder member support in said block member such that the ends of said cylinder open to the outside of said block member and whereby within said block member there is space externally of the cylinder, said cylinder including opposed pistons with piston rods extending out of the opposed ends of said cylinder and said piston rods being provided at their outer ends with follower bearing means for engaging a driven cam surface, (c) a rotary output member mounted for rotation around said support block member and including a generally round exterior surface and a continuous interior driven cam surface for said cylinder, pistons and piston rods spaced from said support block, said driven cam surface being engaged by said follower bearing means to rotate said output member, (d) said driven cam being shaped such that it includes predetermined arcuate areas of constant radius from the axis of the rotary member at least for radially opposed top dead center positions for said pistons in order to allow for predetermined periods of time and degrees of rotation at which the chamber between the pistons is at constant volume, said cam also providing at least radially opposed bottom dead center positions, and said cam further being so shaped that every radius therein has an equal and opposite counterpart radius, (e) said cam also being shaped after the top dead center constant volume areas to provide radially opposed rapid expansion areas of a predetermined number of degrees of rotation of the rotary output member in which a first portion of each of said rapid expansion areas moves the piston away from top dead center at an accelerating velocity and a second portion moves the pistons away at a decelerating velocity toward bottom dead center, and (f) said cylinder being provided with means for admitting fuel thereto, means for timed ignition of the same and further provided with air intake and exhaust gas manifolds and means for selectively opening and closing said cylinder to said intake and exhaust manifolds.

2. The engine according to claim 1 and in which the cam is shaped after bottom dead center to provide opposed return areas of a predetermined number of degrees of rotation of the rotary output member for returning the pistons to the next top dead center area.

3. The engine according to claim 2 and in which said cam is shaped after the top dead center constant volume areas to provide an expansion section having acceleration and deceleration areas and wherein the maximum value of the radius in the acceleration area cannot be greater than any point on a line which is tangent to the last constant radius value of the top dead center area.

4. The engine according to claim 3 and in which the deceleration area of the expansion section in limitation (a) is defined as a curve which continues to move the piston outwardly at a decelerating rate and which rate decreases in reverse order of changes in the radii by which the acceleration area increased.

5. The engine according to claim 4 and in which the expansion section may be of a greater or lesser amount than 90° of rotation in order to extend the pistons to bottom dead center position.

6. The engine according to claim 5 and in which the exhaust section is shaped after bottom dead center position to return the pistons to top dead center position at first slowly and then increases the speed so as to minimize thrust loads on the piston rods and bearings.

7. The engine according to claim 6 and in which said driven cam surface is provided with predetermined arcuate areas of constant radius from the axis of the rotary member for radially opposed bottom dead center positions for the pistons in order to allow for predetermined periods of time and degrees of rotation at which the chamber between the pistons is at constant volume at bottom dead center.

8. The rotary engine according to claim 3 and in which said intake and exhaust manifolds are opened to said cylinder by ports and which ports are opened and closed according to the position of the pistons.

9. The rotary engine according to claim 3 and in which said intake and exhaust manifolds are provided with openings which are provided with and opened and closed by valve members actuated in accordance with the requirements of the engine.

10. The rotary engine according to claim 9 and in which said valve members are provided with stem portions which engage valve cam means against which resilient means are provided to urge said valve members, said valve cam means forming an endless surface and rotating with said rotary output member.

11. The rotary engine according to claim 10 and in which said valve member for said intake manifold is actuated by a first valve cam means and said valve member for said exhaust manifolds is actuated by a second valve cam means, said first and second valve cam means being on opposite sides of said continuous cam.

12. The engine according to claim 3 and wherein said pistons are positively biased outwardly so as to ensure continuous engagement of the follower bearings with the cam surface particularly during the intake stroke.

13. The engine according to claim 3 and in which said engine includes multiple generally parallel, in-line, spaced apart cylinders with opposed pistons and each cylinder having its own driven and valve cams.

14. The engine according to claim 13 and in which the driven cams for the individual cylinders are angularly positioned with respect to each other so that the mass of the rotary output member is balanced.

15. The engine according to claim 3 and wherein the expansion section from the last constant radius of the top dead center area to the first or only radius at bottom dead center is a harmonic curve setting forth the radii as $$R_\theta = S + [1 - \text{Cos}\,(u)]$$

where $$u = \frac{\pi}{L}(\theta - k)$$

k = beginning radius point of the harmonic curve (last constant radius at top dead center)

m = ending radius point for the harmonic curve (first or only radius at bottom dead center)

L = 180 − (k + m)

S = ½ distance of travel of one piston $\theta$ = angle of R from 0°.

16. The engine according to claim 15 and in which the deceleration area of the expansion section in limitation (a) is defined as a curve which continues to move the piston outwardly at a decelerating rate and which rate decreases in reverse order of changes in the radii by which the acceleration area increased.

17. The engine according to claim 16 and in which the expansion section may be of a greater or lesser amount than 90° of rotation in order to extend the pistons to bottom dead center position.

18. The engine according to claim 17 and in which the exhaust section is shaped after bottom dead center position to return the pistons to top dead center position at first slowly and then increases the speed so as to minimize thrust loads on the piston rods and bearings.

19. The engine according to claim 18 and in which said driven cam surface is provided with predetermined arcuate areas of constant radius from the axis of the rotary member for radially opposed bottom dead center positions for the pistons in order to allow for predetermined periods of time and degrees of rotation at which the chamber between the pistons is at constant volume at bottom dead center.

20. The rotary engine according to claim 15 and in which said intake and exhaust manifolds are opened to said cylinder by ports and which ports are opened and closed according to the position of the pistons.

21. The rotary engine according to claim 15 and in which said intake and exhaust manifolds are provided with openings which are provided with and opened and closed by valve members actuated in accordance with the requirements of the engine.

22. The rotary engine according to claim 21 and in which said valve members are provided with stem portions which engage valve cam means against which resilient means are provided to urge said valve members, said valve cam means forming an endless surface and rotating with said rotary output member.

23. The rotary engine according to claim 22 and in which said valve member for said intake manifold is actuated by a first valve cam means and said valve member for said exhaust manifolds is actuated by a second valve cam means, said first and second valve cam means being on opposite sides of said continuous cam.

24. The engine according to claim 15 and wherein said pistons are positively biased outwardly so as to ensure continuous engagement of the follower bearings with the cam surface particularly during the intake stroke.

25. The engine according to claim 15 and in which said engine includes multiple generally parallel, in-line, spaced apart cylinders with opposed pistons and each cylinder having its own driven and valve cams.

26. The engine according to claim 13 and in which the driven cams for the individual cylinders are angularly positioned with respect to each other so that the mass of the rotary output member is balanced.

27. A reciprocating, rotary, combustion engine, comprising:

(a) a hollow, non-rotatable support block member of predetermined length and adapted to be supported in an operative position, (b) at least one cylinder member supported in said block member such that the ends of said cylinder open to the outside of said block member and whereby within said block member there is space externally of the cylinder, said cylinder including opposed pistons with piston rods extending out of the opposed ends of said cylinder and said piston rods being provided at their outer ends with follower bearing means for engaging a driven cam surface, (c) a rotary output member mounted for rotation around said support block member and including a generally round exterior surface and a continuous interior driven cam surface for said cylinder, (d) said cam being shaped such that it includes predetermined arcuate areas of constant radius from the axis of the rotary member at least for radially equal and opposed top dead center positions for said pistons in order to allow for predetermined periods of time and degrees of rotation at which the chamber between the pistons is at constant volume, said cam also providing at least radially equal and opposed bottom dead center positions, and said cam further being shaped such that every radius therein has an equal and opposite counterpart radius, (e) said cam being shaped after the top dead center constant volume areas to provide an expansion section having an acceleration area for moving the pistons away from top dead center at an accelerating velocity and then a deceleration area for moving the pistons away from top dead center at a decelerating velocity toward bottom dead center, and wherein the maximum value of the radius in the acceleration areas cannot be greater than any point on a line which is tangent to the last constant radius value of the top dead center area, and (f) said cylinder being provided with means for admitting fuel thereto, means for timed ignition of the same and further provided with air intake and exhaust gas manifolds and means for selectively opening and closing said cylinder to said intake and exhaust manifolds.

28. The engine according to claim 27 and in which the cam is shaped after bottom dead center to provide opposed return areas of a predetermined number of degrees of rotation of the rotary output member for returning the pistons to the next top dead center area.

29. The engine according to claim 28 and in which the deceleration area of the expansion section in limitation (e) is defined as a curve which continues to move the piston outwardly at a decelerating rate and which rate decreases in reverse order of changes in the radii by which the acceleration area increased.

30. The engine according to claim 29 and in which the expansion section may be of a greater or lesser amount than 90° of rotation in order to extend the pistons to bottom dead center position.

31. The engine according to claim 30 and in which the areas of acceleration and deceleration may be of unequal degrees of rotation.

32. The engine according to claim 28 and in which the expansion section from the last constant radius of the top dead center area to the first or only radius at bottom dead center is a harmonic curve setting forth the radii as $$R_\theta = S + [1 - \text{Cos}\,(u)]$$

where $$u = \frac{\pi}{L}(\theta - k)$$

k = beginning radius point of the harmonic curve (last constant radius at top dead center)

m = ending radius point for the harmonic curve (first or only radius at bottom dead center)

L = 180 − (k + m)

S = ½ distance of travel of one piston, $\theta$ = angle of R from 0°.

33. The engine according to claim 28 and in which the exhaust section is shaped after bottom dead center position to return the pistons to top dead center position at first slowly and then increases the speed so as to minimize thrust loads on the piston rods and bearings.

34. The engine according to claim 33 and in which said driven cam surface is provided with predetermined arcuate areas of constant radius from the axis of the rotary member for radially opposed bottom dead center positions for the pistons in order to allow for predetermined periods of time and degrees of rotation at which the chamber between the pistons is at constant volume at bottom dead center.

35. The rotary engine according to claim 28 and in which said intake and exhaust manifolds are opened to said cylinder by ports and which ports are opened and closed according to the position of the pistons.

36. The rotary engine according to claim 28 and in which said intake and exhaust manifolds are provided with openings which are provided with and opened and closed by valve members actuated in accordance with the requirements of the engine.

37. The rotary engine according to claim 36 and in which said valve members are provided with stem portions which engage valve cam means against which resilient means are provided to urge said valve members, said valve cam means forming an endless surface and rotating with said rotary output member.

38. The rotary engine according to claim 37 and in which said valve member for said intake manifold is actuated by a first valve cam means and said valve member for said exhaust manifold is actuated by a second valve cam means, said first and second valve cam means being on opposite sides of said continuous cam.

39. The engine according to claim 28 and wherein said pistons are positively biased outwardly so as to ensure continuous engagement of the follower bearings with the cam surface particularly during the intake stroke.

40. The engine according to claim 28 and in which said engine includes mulitple generally parallel, in-line, spaced apart cylinders with opposed pistons and each cylinder having its own driven and valve cams.

41. The engine according to claim 40 and in which the driven cams for the individual cylinders are angularly positioned with respect to each other so that the mass of the rotary output member is balanced.

* * * * *